United States Patent [19]

Richardson et al.

[11] 4,285,150

[45] Aug. 25, 1981

[54] DISPLAY BOX

[75] Inventors: William C. Richardson, Sparta, N.J.; Mario Isoldi, Staten Island, N.Y.

[73] Assignee: Album Graphics, Incorporated, New York, N.Y.

[21] Appl. No.: 197,018

[22] Filed: Oct. 15, 1980

[51] Int. Cl.[3] ..... G09F 1/12

[52] U.S. Cl. ..... 40/312; 229/16 D; 229/41 B

[58] Field of Search ..... 229/16 R, 16 D, 17 R, 229/16 C, 41 B; 40/312, 124.2; 312/234.1

[56] References Cited

U.S. PATENT DOCUMENTS

| | | | |
|---|---|---|---|
| 1,299,645 | 4/1919 | Whitmore | 40/312 |
| 1,544,463 | 6/1925 | Lengsfield | 40/312 |
| 1,568,982 | 1/1926 | Lengsfield | 40/312 |
| 2,112,879 | 4/1938 | Broderick | 229/16 R |
| 2,347,021 | 4/1944 | Auerback | 229/17 R |
| 3,415,407 | 12/1968 | Alden et al. | 40/312 |
| 3,592,337 | 7/1971 | Phillips | 229/16 D |
| 4,206,869 | 1/1980 | Gurevitz | 312/234.1 |

FOREIGN PATENT DOCUMENTS

| | | | |
|---|---|---|---|
| 250698 | 4/1926 | United Kingdom | 40/312 |

*Primary Examiner*—Gene Mancene
*Assistant Examiner*—Wenceslao J. Contreras
*Attorney, Agent, or Firm*—Davis, Hoxie, Faithfull & Hapgood

[57] ABSTRACT

A folded paper box is provided which locks in the erected condition and has apertures in the exterior panels through which a label insert sheet is visible and interior panels which cover the apertures and insert sheet when in place.

4 Claims, 4 Drawing Figures

DISPLAY BOX

BACKGROUND

Many products are identical in configuration, but different in content, as for example, pre-recorded video tapes. Such products are capable of being packaged in identical boxes, but require a different label for each content. Consequently, the packager must inventory stocks of boxes differently labeled for each content, but otherwise similar, or must himself adhere different labels thereby necessitating the use of an inelegant form of label and inviting inaccurate label placement.

SUMMARY OF THE INVENTION

The present invention provides a box arranged to receive a unitary label insert sheet which is visible through apertures in the exterior panels of the box and which automatically is positioned accurately with respect to the apertures. Only one type of box need be stocked since it can receive different label inserts according to needs. The box is provided with several apertures through which appropriate regions of a single sheet label insert are visible. The box is erected easily from a partially pre-folded blank and when erected is self-locking into a sturdy structure. The blank is laid out so that all interior and exterior surfaces of the box are the same face of the blank, thereby allowing decoration of only that face of the blank. The entire interior of the box is lined to cover the label insert completely. The box has a hinged, recloseable lid.

DESCRIPTION OF A PREFERRED EMBODIMENT

Figure 1:
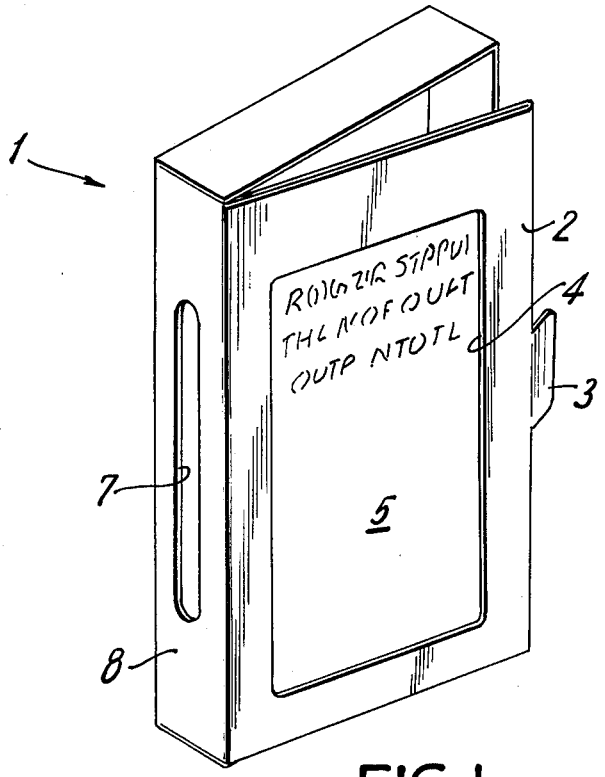
FIG. 1 is a perspective view of the erected box.
Figure 2:
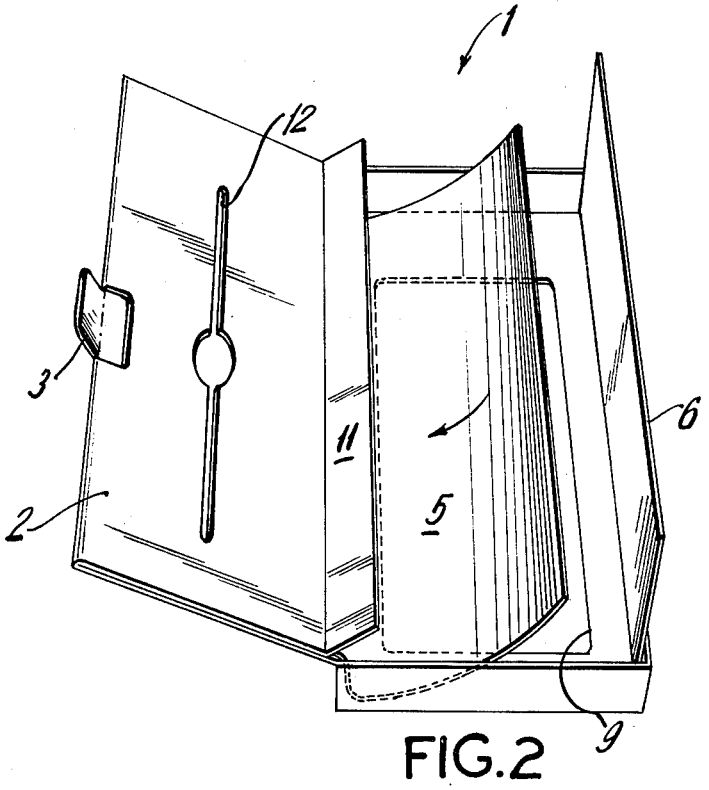
FIG. 2 is a perspective view showing the label insert in place in the box.

Referring now to FIGS. 1 and 2, a box 1 according to the present invention is shown erected and completed. The box is suitable for packaging a variety of goods ranging from picture puzzles to cosmetics, and is herein described as a box for pre-recorded video tape. The box 1 is provided with a hinged lid 2 having an aperture 4 through which a label insert 5 is visible. The spine side 8 of the box is provided with a label aperture 7. The back or floor of the box is also provided with a label aperture 9. The lid 2 is provided with a closure tongue 3 receivable in an appropriate slit for holding the lid closed.

The lid 2 is formed by a folding of two panels to create an envelope pocket to receive the label insert 5. The opposite end portion of the label insert 5 which overlies the aperture 9 in the back or floor of the box is covered by an interior floor panel 6. The middle portion of the label insert which overlies the spine aperture 7 is covered by a flap 11. Thus, the interior panels of the box completely cover the label insert 5. A slot 12 in the interior panel of the lid 2 permits the insertion of a booklet or other document such as a libretto, catalog, commentary, or instructions.

Figure 3:
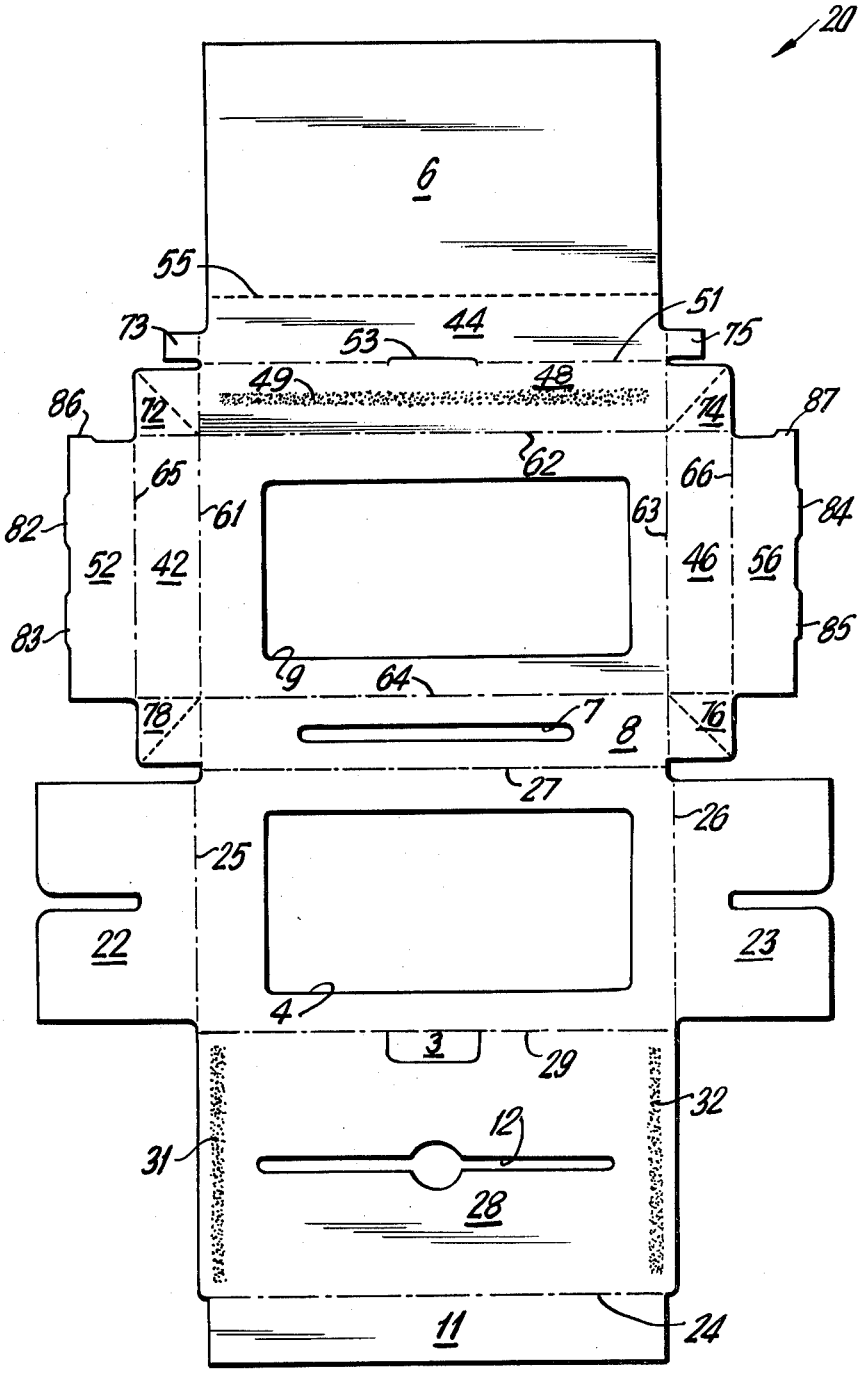
FIG. 3 shows the blank from which the box is erected.

FIG. 3 shows the unitary blank, generally designated as 20, from which the box is erected. The blank is cut from appropriate paper stock by conventional techniques. The blank is laid out to fold up in such a way as to present the same primary surface of the blank on all exterior and interior surfaces of the box, thereby confining the need for decoration, color, coating, or film lamination to the primary face of the paper stock. The undecorated secondary face of the blank is seen in FIG. 3.

The lid 2 is formed by folding flaps 22, 23 along fold lines 25, 26 respectively and folding panel 28 along fold line 29. Adhesive such as a melted thermoplastic is applied in the areas designated 31, 32 to adhere panel 28 to flaps 22, 23. Tongue 3 protrudes from the fold line 29 edge of the resulting lid. Panel 28 becomes the interior face of the lid 2 and lid 2 is in the form of a pocket or envelope for receipt of the label insert. Fold line 27 constitutes the lid hinge.

The body of the box is formed by folding interior floor panel 6 and interior side panel 44 along fold line 51 and adhering panel 44 to exterior side panel 48 with adhesive in the area designated 49. Fold line 51 includes a slit 53 for receipt of lid closure tongue 3. The side exterior panels 42, 46, 8 and 48 are folded upwardly along fold lines 51–64. Score line 55 separating panels 44 and 6 is provided to ease the folding of the double thickness at fold line 62. Corner gusset pieces 72, 74, 76 and 78 are each provided with a diagonal score line to promote inward pleat-folding of these corner reinforcing gussets. Tabs 73, 75 protuberant from panel 44 fold inwardly with corner pieces 72 and 74. Side interior panel flaps 52, 56 are then folded downwardly along fold lines 65, 66 to overlie pleated corner gussets 72, 74, 76, and 78 and tabs 73 and 75. Small tongues 82–85 snap between the edges of interior floor panel 6 and side panels 42 and 46. Similarly, small tongues 86, 87 snap below tabs 73, 75. The tongues 82–87 lock the flaps 52, 56 in place and thereby secure the four sides of the box in the erected condition.

A label insert 5 can be slipped into the pocket of lid 2 to be visible through lid aperture 4 and spine aperture 7. The insert 5 overlies floor aperture 9 and is covered by interior floor panel 6. If desired, a transparent sheet can be adhered to the interior face of blank 20 to overlie apertures 4, 7 and 9 to form protective windows through which the label insert is visible. An appropriate information sheet or booklet can be slipped into slot 12 of lid 2.

Figure 4:
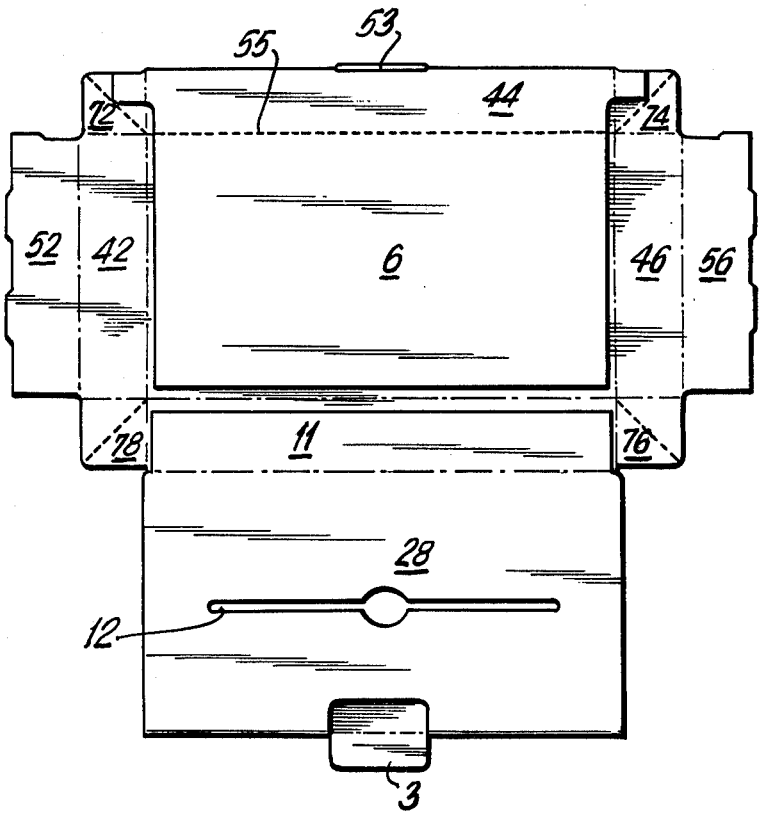
FIG. 4 shows the blank in a pre-assembled condition.

The box can be erected by the box manufacturer and shipped erected to the packager for label insertion and filling or, as shown in FIG. 4, the blank can be folded at fold lines 29, 25, 26 and 51 and glued at areas 31, 32, and 49 by the box manufacturer. This results in a partially pre-assembled unit which can be shipped flat. The label insert 5 can be placed in the pre-assembled unit before the box is erected by the packager.

The box of the present invention is formed from a single unitary blank decorated on but one surface and presents that decorated surface on all exterior and interior surfaces of the box. The printing or decorating of the box blank and the label are independent to allow the packager to label boxes to suit the needs of the packager's market, an ability highly desired by those who package video or music tapes and the like. The box of the present invention is well suited to packaging of a line of different products in identical boxes for uniformity of product line image while permitting a different label for each product. Because of the manner in which the single sheet label insert is received in the box, the labeling cannot be other than straight and properly registered with the apertures, thus assuring a neat, inexpensive package suitable even for an expensive product. Since the label insert is separate from the box, the cost of elegant print work may be confined to that insert rather than borne by the entire box.

We claim:

1. A box formed from a unitary blank having a primary face and a secondary face, said box having an integral hinged lid;

the lid being a fold of a first panel over a second panel of the blank, the first panel constituting the interior lid panel and the second panel constituting the exterior lid panel to present the primary face of the blank outwardly on both faces of the lid, and inwardly folded flaps on each end of one of said first and second panels adhered to the secondary face of the other of said panels to form a pocket in the lid for receipt of a label insert;

the body of the box being formed from four side panels folded upwardly, one on each edge of an exterior floor panel, a first one of said side panels being integral with the exterior lid panel, the fourth side panel being integral with an interior floor panel, the interior floor panel being folded over the exterior floor panel and the fourth side panel with the secondary faces confronting, a portion of the interior floor panel being folded upwardly with the fourth side panel and the remainder overlying the exterior floor panel, the second and third side panels having inwardly and downwardly folded flaps captured between the edges of the interior floor panel and the second and third side panels, whereby all exterior and interior surfaces of the box are the primary face of the blank;

apertures in the exterior panels of at least the lid through which a label insert is visible, the interior panels overlying the label insert apertures.

2. The box of claim 1 wherein the exterior panels of the floor and the side adjacent the lid have apertures through which a label insert is visible.

3. The box of claim 2 further including a label insert sheet placed between the exterior and interior panels of the lid and floor.

4. The box of claim 3 wherein the label insert is a unitary piece.

* * * * *